United States Patent [19]

Grabowski

[11] Patent Number: 4,974,237

[45] Date of Patent: Nov. 27, 1990

[54] CONTACT TYPE PAPER COUNTER

[75] Inventor: Richard Grabowski, Garfield Heights, Ohio

[73] Assignee: Hall Processing Systems, Westlake, Ohio

[21] Appl. No.: 322,536

[22] Filed: Mar. 13, 1989

[51] Int. Cl.[5] ..... G06M 7/00

[52] U.S. Cl. ..... 377/008; 235/98 B

[58] Field of Search ..... 377/8; 235/98 B

[56] References Cited

U.S. PATENT DOCUMENTS

| | | | |
|---|---|---|---|
| 1,544,860 | 7/1925 | Reisbach | 377/8 |
| 1,557,944 | 10/1925 | Reisbach | 229/120.32 |
| 3,571,574 | 3/1971 | Gerber | 377/8 |
| 3,746,841 | 7/1973 | Fenske | 377/8 |
| 3,813,522 | 5/1972 | McCarthy | 377/8 |
| 3,862,402 | 11/1975 | Igarashi | 377/8 |
| 3,983,367 | 9/1976 | Kondo et al. | 377/8 |
| 4,139,765 | 2/1979 | Pomey | 377/8 |
| 4,481,667 | 11/1984 | Price et al. | 377/8 |
| 4,539,470 | 9/1985 | Honegger et al. | 377/8 |

FOREIGN PATENT DOCUMENTS

| | | |
|---|---|---|
| 5843080 | 3/1983 | Japan . |
| 5846484 | 3/1983 | Japan . |
| 5846485 | 3/1983 | Japan . |
| 58670385 | 4/1983 | Japan . |

*Primary Examiner*—John S. Heyman

*Attorney, Agent, or Firm*—Fay, Sharpe, Beall, Fagan, Minnich & McKee

[57] ABSTRACT

A contact sensor apparatus counts associated sheet products as they pass over a generally planar surface. a vacuum source draws a bottom surface of a sheet product onto the planar surface. A contact member is selectively deflected through engagement with the sheet product and deflects upwardly at the passage of the trailing edge of the sheet product. The contact member is connected to a sheet of piezoelectric material that is distorted upon deflection of the contact member. This produces an electrical charge representative of passage of paper over the sensor apparatus.

19 Claims, 2 Drawing Sheets

CONTACT TYPE PAPER COUNTER

BACKGROUND OF THE INVENTION

This invention pertains to the art of sensors and more particularly, to contact type sensors used for monitoring or counting sheet products.

The invention is particularly applicable to counting paper products such as newspapers and will be described with particular reference thereto. However, it will be appreciated that the invention has broader applications and may be advantageously employed in other sheet product environments and applications.

Two general categories of paper counters are utilized in the industry. A mechanical or contact type counter is relatively inexpensive. Typically a sprocket or star-shaped wheel engages a leading or front edge of each newspaper in a lapped stream as it passes by the mechanical counter. Particularly, distinct lobes of the rotary, mechanical counter engage successive newspapers in the lapped stream. Rotation of the counter is monitored to indicate the number of newspapers that have passed.

Even though, as indicated above, these mechanical counters are relatively inexpensive, they are deemed ineffective and result in wide variations of efficiency. Particularly, mechanical counters are not generally applicable to product streams comprised of single sheet papers or other small thicknesses of papers due to the limited height differential between adjacent papers. Additionally, papers having limited thickness will not impose a substantial enough force on a lobe to register a "count". Rather than actuating the lobes of the star-shaped wheel, the papers may become dislodged from their imbricated arrangement resulting in bunching of the papers.

Mechanical counters necessarily count the leading or folded edge of the paper and in some situations it may be preferable to count the trailing edge. That is, the papers must be oriented so that the leading edge of each paper is exposed for contact with the mechanical counter. Typically, the papers are disposed on a conveyor surface with the lobes of a mechanical counter extending toward the conveyor surface and into the path of the papers. For example, with a selected paper, the trailing edge of a next adjacent, downstream paper is received underneath the leading edge of the paper. The trailing edge of the paper is received underneath the next adjacent, upstream paper so that the leading edges are disposed for contact with the mechanical counter. Even with these drawbacks, the mechanical counter is widely used in the industry.

A more recent introduction to the industry is a laser type counter. The laser type counter is deemed to be more reliable and effective than a mechanical counter but is also very expensive due to its complexity. Even then, the laser type counter is susceptible to problems with color and/or ripples in the sheet product. That is, if the sheet product has ripples the laser will provide additional counts because of the deviation from a planar, "standard" sheet product conformation.

Still another problem associated with laser type counters is the ineffectiveness that results from certain types of sheet products. For example, newspapers that have large pictures on a page facing the laser sensor rather than substantial text material are often miscounted. It is believed that such errors result from the pictures absorbing the light and providing insufficient feedback to the laser sensor to adequately count the sheet products.

SUMMARY OF THE INVENTION

The present invention contemplates a new and improved contact type sensor or counter that overcomes all of the above-referred to problems of both mechanical and laser type counters and provides an intermediately priced unit that is simple, economical, and extremely efficient.

According to the invention, there is provided a sensor apparatus adapted for counting sheet products as the sheet products pass over a generally planar surface. A means for supplying a vacuum to a preselected region of the planar surface draws the sheet products into engagement with a contact member. Means for detecting movement of the contact member records the passing of each sheet product.

According to another aspect of the invention, the detecting means includes a transducer operatively associated with the contact member. Deflection of the contact member produces an electrical signal representing advancement of a sheet product past the contact member.

According to yet another aspect of the invention, means for biasing the contact member outwardly from the planar surface is provided.

According to a still further aspect of the invention, the preselected region of the surface connected to vacuum is disposed downstream from the contact member.

A principal advantage of the invention resides in the ability to count small thicknesses of sheet products, even single sheet products, as well as intermediate thicknesses of sheet products.

Another advantage of the invention resides in the high efficiency in counting sheet products.

Still another advantage of the invention is realized in the intermediate cost of the contact type counter.

Yet another advantage of the invention resides in the ability to count the trailing edge of sheet products.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
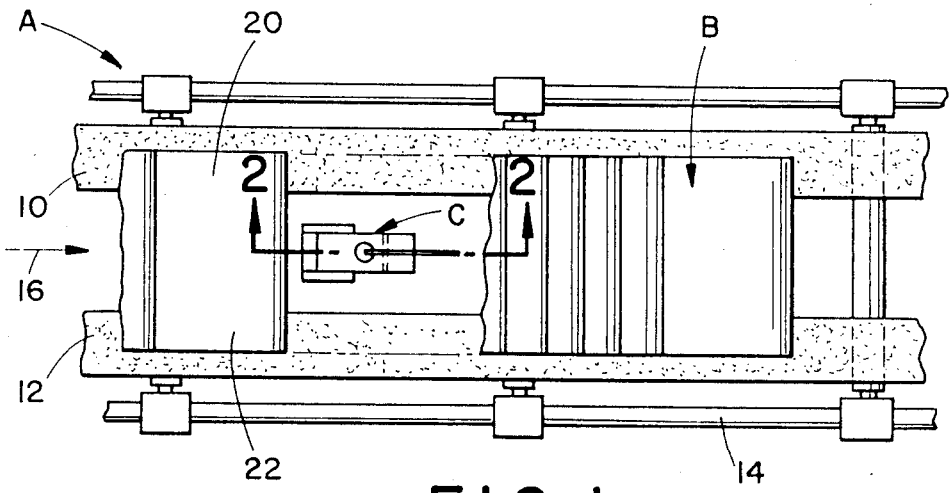
FIG. 1 is a top plan view of a conveyor assembly transporting a lapped stream of sheet products with selected sheet products broken away to illustrate positioning of the subject invention.

Referring now to the drawings wherein the showings are for purposes of illustrating the preferred embodiment of the invention only, and not for purposes of limiting same, the FIGURES show a conveyor assembly A transporting a lapped stream of sheet products such as newspapers B along a predetermined workpath. The newspapers cooperate with a sensor apparatus C for effective monitoring or counting of the newspapers in the lapped stream.

More particularly, the conveyor assembly may be of any conventional type arrangement but as illustrated includes first and second endless conveyor belts 10, 12 supported by a suitable frame 14 for transporting sheet products B along a workpath represented by arrow 16. The first and second conveyor belts are adapted to support lateral, first and second edges 20, 22 of the individual newspapers. The conveyor belts are merely representative of one type of assembly for transporting sheet products such as newspapers along the workpath. An alternative arrangement of drive conveyors may be utilized with equal success.

The newspapers are disposed in an imbricated or lapped stream arrangement in which a leading edge 30 of a newspaper is received above the trailing edge 32 of a next adjacent downstream newspaper. The axial spacing of the imbricated newspapers is merely for purposes of illustration. That is, one of ordinary skill in the art will understand that the leading edges of adjacent newspapers may be more closely disposed together or spread apart as desired and as necessary for a particular application without departing from the scope and intent of the subject invention.

At a predetermined area along the longitudinal workpath, the newspapers are monitored by sensor apparatus C to provide an accurate count. The sensor apparatus includes an external housing 40 having a generally planar or first surface 42 adapted to receive the newspaper stream in sliding relation thereover. A tapered surface 44 is disposed upstream and adjacent the first surface. The tapered surface extends toward the newspaper stream from a housing sidewall to present a smooth transition surface for each newspaper over the sensor apparatus. The housing may be suitably secured to a base member 46 which, in turn, is secured to the frame 14 in any conventional manner. It is important, though, to position the planar surface 42 along a plane defined by the bottom surfaces of the newspapers.

A downstream region 50 of the first surface includes at least one aperture 52. The aperture is defined in a manifold block 54 that communicates through fluid line 56 with a source of vacuum 58. The vacuum source may be contained within the housing or, alternatively, may be an external source including suitable fluid lines for interconnecting with fluid line 56. Additionally, a filtering arrangement may be associated with the vacuum source and fluid lines to maintain effective suction and urge by drawing the sheet products toward surface 42. It is contemplated that fitting 60 may be secured to a fluid pressure source that selectively provides fluid pressure to line 56. A purging pressure/vacuum cycling arrangement thus effectively draws the sheet products toward the sensor apparatus and keeps the fluid lines free of debris. Whenever the manifold is in fluid communication with the vacuum source a suction region is defined at aperture 52.

Disposed immediately upstream of the aperture 52 is a first end 62 of a contact member 64. The first end extends generally normally outward from the first surface 42 for selective contact or engagement with a lower or bottom edge of a sheet product. An elongated, intermediate portion 66 of the contact member transmits the vertical, reciprocating movement of the first end to a second end 68. The intermediate portion is normally disposed generally parallel to the first surface 42 while the second end 68 extends in generally perpendicular relation thereto.

The contact member second end is secured to a clamping assembly 80, particularly a first arm 82 of the clamping assembly. The first arm is secured to a vertically extending post 84 by means of a pin 86 so that it rotates around the pin and relative to the remainder of the clamping assembly in response to deflecting forces imposed thereon by the contact member. The lower portion of the post 88 is secured to the housing and a fixed, second arm 90 extends therefrom in spaced relation to the first arm. A biasing means such as spring 100 is received around rod 102 and traverses the gap between the first and second arms. The upper end of the rod is freely received through the first arm to permit selective rotation of the first arm about pin 86. The spring normally biases the first arm 82 in generally parallel relation with the second arm 90 and, likewise, disposes the first end 62 of the contact member outwardly from the planar upper surface 42 for selective engagement with the bottom surface of the newspapers.

Also interposed between the first and second arms is a transducer defined by a sheet of piezoelectric material 104 that is preferably placed under a slight tensile force due to the biasing force of spring 100. The piezoelectric material is defined by a material having ionic bonds where the atoms are disposed in positive-negative pairs known as dipoles. Stated in another manner, the positive and negative ions in the piezoelectric material are aligned as exhibited in asymmetrical crystalline materials. This dipole arrangement results in an electrical charge when the material is distorted from its aligned crystalline state. That is, the slight tensile force imposed on the material assures that the crystals are aligned. Even a small deflection or displacement of pin 62 distorts the piezoelectric material and produces an electrical charge.

Figure 4:
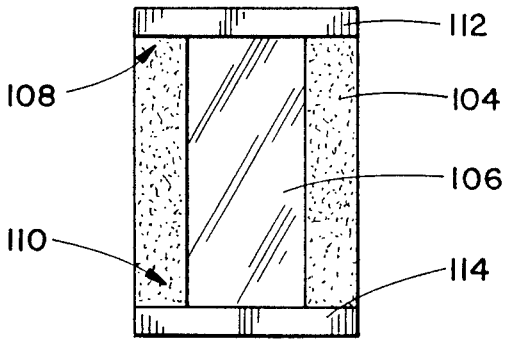

With additional reference o FIG. 4, the piezoelectric material 104 and its particular mounting arrangement is shown in greater detail. Metal laminates 106 are disposed along exposed faces of the piezoelectric material. The laminates define a conductor member so that any electrical charge produced by deflection of the piezoelectric material is readily received by the conductor member and processed as will become more apparent below. Opposed ends 108, 110 of the piezoelectric material are received in insulative material strips 112, 114 to eliminate any adverse electrical interaction with the clamp arms 82, 90.

Figure 2:
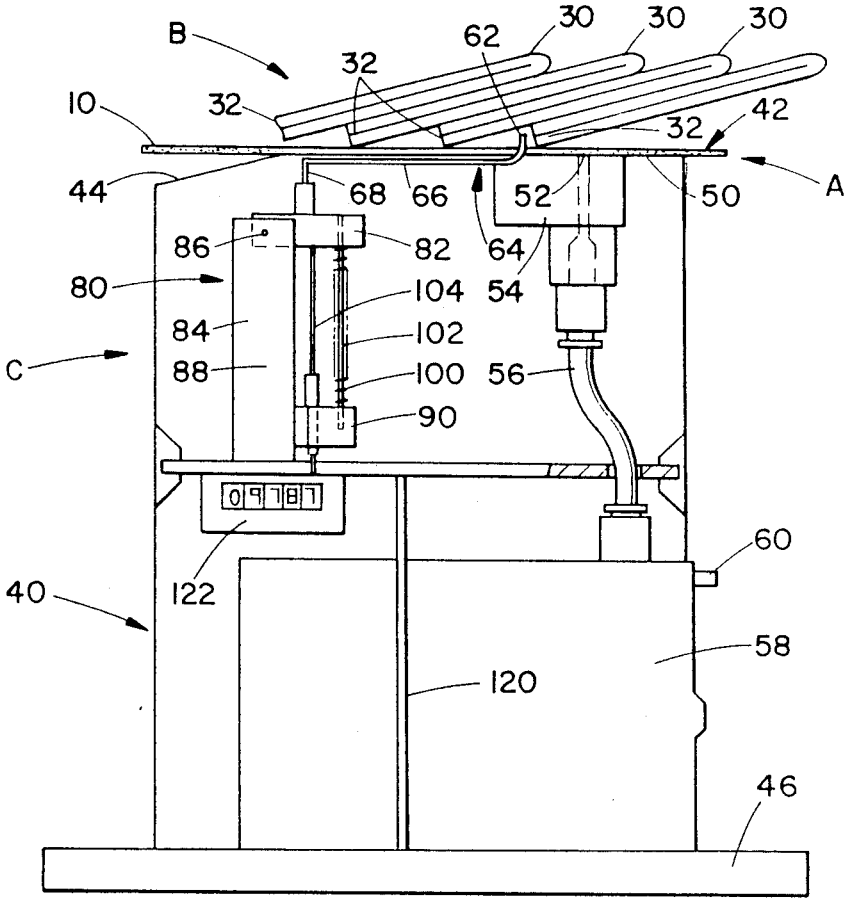
FIG. 2 is an enlarged sectional view of the subject invention taken generally along the lines 2—2 of FIG. 1.

Turning again to FIG. 2, the conductive laminates 106 are connected to a signal conditioning board 120. The electrical signal produced by the distortion of the piezoelectric material is amplified and further processed for signal handling. Particular details of the electrical circuit for amplifying the signal are not believed necessary to a full and complete understanding of the subject invention.

Figure 3:
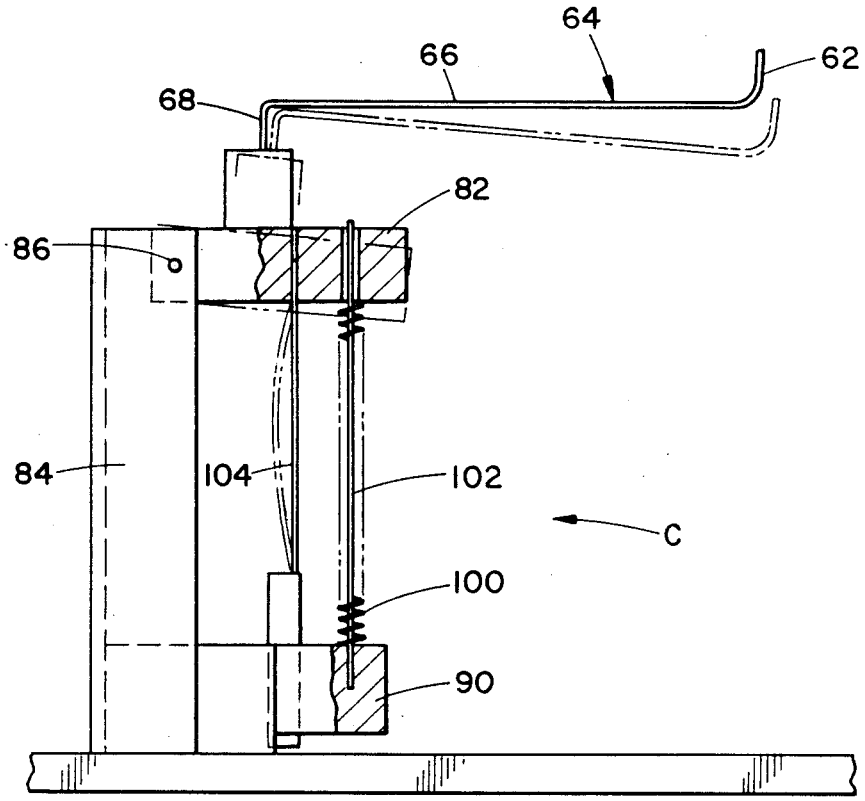
FIG. 3 is an enlarged view of the detecting means of the subject invention; and, FIG. 4 is a plan view of the piezoelectric material used in the detecting means of the subject invention.

The signal conditioning board 120, though, does communicate with a suitable monitoring system, such as an electrical counter, to provide a representative count of the newspapers as illustrated by indicia means 122. As shown, the indicia means represents the number of newspapers that have deflected the contact member from its outwardly biased position, thus distorting the piezoelectric material as illustrated in FIG. 3, and producing a signal that is amplified and processed in board 120. Of course, one skilled in the art will realize that other monitoring systems or means of displaying the count number of newspapers can be utilized without departing from the overall scope and intent of the subject invention.

In operation, a newspaper is advanced by the conveyor assembly onto surface 42 of the sensor apparatus. Continued advancement of the newspaper deflects the contact member first end 62 downwardly due to engagement with the bottom surface and vacuum. This deflecting movement is transmitted through intermediate portion 66 of the contact member for selective rotation of the first arm 82 about pin 86 of the clamping assembly. Rotational movement of the first arm distorts the piezoelectric material which produces an electrical charge that is picked up by the conductive laminates 106.

The newspaper continues its advancement along the workpath 16 and the vacuum source supplied through port 52 continues to draw the paper toward the planar surface 42. This suction or vacuum arrangement maintains the contact member in a depressed state until the trailing edge of a selected paper passes thereover. The leading edge of an adjacent, upstream newspaper is supported by the trailing edge of the selected paper and defines a gap in which the first end 62 of the contact member may be received. The bottom face of the adjacent upstream paper is not pulled downwardly by the vacuum source since the trailing edge of the selected newspaper supports the bottom surface above the first surface of the housing. Support of the leading edge or midsection of one paper by the trailing edge of the adjacent, downstream paper permits the biasing force of spring 100 to urge the contact member upwardly into this gap. The upward movement of the contact member also permits the piezoelectric material to assume its original, slightly tensioned configuration which produces a negative charge indicating the passage of the trailing edge of the selected paper. The process is then repeated for adjacent, upstream newspapers in the lapped stream.

The invention has been described with reference to the preferred embodiment. Obviously modifications and alterations will occur to others upon a reading and understanding of this specification. It is intended to include all such modifications and alterations in so far as they come within the scope of the appended claims or the equivalents thereof.

Having thus described the invention, it is now claimed:

1. A sensor apparatus adapted to count associated sheet products, said apparatus comprising:

a first surface adapted to receive sheet products thereon;

a vacuum source;

a predetermined region of said first surface adapted for connection with the vacuum source to draw associated sheet products toward the first surface;

a contact member extending outwardly from said first surface and adapted for selective movement relative thereto as an associated sheet product slides over said contact member; and, means for detecting movement of said contact member.

2. The sensor apparatus as defined in claim 1 further comprising means for biasing said contact member outwardly from said first surface.

3. The sensor apparatus as defined in claim 1 wherein said detecting means includes a piezoelectric material operatively engaging said contact member, said piezoelectric material being distorted when said contact member selectively moves as an associated sheet product slides thereover.

4. The sensor apparatus as defined in claim 3 wherein distortion of said piezoelectric material produces an electrical signal which is amplified and represents advancement of an associated sheet product past the contact member.

5. The sensor apparatus as defined in claim 1 wherein said contact member is disposed upstream of said preselected region for initial engagement with the sheet product.

6. The sensor apparatus as defined in claim 1 wherein said contact member includes a first end protruding outwardly from said first surface, a second end operatively connected to said detecting means, and an elongated intermediate portion connecting said first and second ends.

7. The sensor apparatus as defined in claim 1 wherein said detecting means includes a clamp assembly having first and second arms receiving opposite ends of a piezoelectric material, said first arm adapted for selective movement relative to said second arm, and said contact member being operatively connected to said first arm.

8. The sensor apparatus as defined in claim 1 further comprising means for selectively purging the predetermined region of the first surface.

9. A sensor apparatus adapted to count associated sheet products comprising:

a generally planar surface adapted to receive associated sheet products thereon;

a contact member extending outwardly from said generally planar surface and adapted to engage associated sheet products, said contact member selectively moving in response to engagement with associated sheet products; and, means adapted for drawing an associated sheet product toward said generally planar surface, said drawing means being disposed on the same side of the associated sheet product as the contact member.

10. The sensor apparatus as defined in claim 9 wherein said drawing means includes a preselected region on said generally planar surface for connection with a vacuum supply.

11. The sensor apparatus as defined in claim 9 wherein said drawing means is disposed downstream of said contact member.

12. The sensor apparatus as defined in claim 9 further comprising means for biasing said contact member outwardly from said generally planar surface.

13. The sensor apparatus as defined in claim 9 further comprising a transducer operatively associated with the contact member for selectively providing an electrical signal representative of movement of the contact member.

14. The sensor apparatus as defined in claim 13 further comprising a clamp member having first and second arms receiving opposite ends of said transducer, said first arm mounted for movement relative to said second arm, and said contact member being secured to said first arm whereby movement thereof is transmitted to said transducer.

15. The sensor apparatus as defined in claim 14 further comprising means for insulating said opposed ends of said transducer from said first and second arms.

16. The sensor apparatus as defined in claim 13 further comprising means for processing said electrical signal, said processing means being operatively connected to said transducer.

17. A contact sensor apparatus adapted to count associated sheet products comprising:

a generally planar surface adapted to receive associated sheet products;

means for supplying a vacuum to a preselected region of said generally planar surface, said vacuum supplying means adapted to draw an associated sheet product toward said generally planar surface;

a contact member extending outwardly from said generally planar surface and adapted for selective movement relative thereto as an associated sheet product slides over said contact member; and, a transducer operatively associated with said contact member selectively providing an electrical signal representative of movement of said contact member.

18. The contact sensor apparatus as defined in claim 17 further comprising means for biasing said contact member outwardly from said generally planar surface.

19. The contact sensor apparatus as defined in claim 17 wherein said transducer is a piezoelectric material.

* * * * *